US005148937A

United States Patent [19]

Huard

[11] Patent Number: 5,148,937

[45] Date of Patent: Sep. 22, 1992

[54] CAP WITH PERFORATING SPIKE FOR CONTAINER WITH A PROTECTIVE MEMBRANE

[75] Inventor: Albert Huard, Greenfield Park, Canada

[73] Assignee: Dero Enterprises Inc., Montreal, Canada

[21] Appl. No.: 812,019

[22] Filed: Dec. 23, 1991

[51] Int. Cl.[5] ..... B65D 17/44

[52] U.S. Cl. ..... 220/278; 220/212; 220/267; 220/277; 220/257; 215/228

[58] Field of Search ..... 220/278, 212, 379, 744, 220/267, 277; 215/228, 215, 226, 257, 295, 303, 301, 232

[56] References Cited

U.S. PATENT DOCUMENTS

| | | | |
|---|---|---|---|
| 1,517,089 | 11/1924 | Moore | 220/278 |
| 2,009,257 | 7/1935 | Goldberg | 220/277 X |
| 2,131,774 | 10/1930 | Waring | 265/250 |
| 2,131,,775 | 10/1938 | Waring | 215/250 |
| 3,390,804 | 7/1968 | Morgan | 220/212 |
| 4,204,604 | 5/1980 | Morin et al. | 215/257 |
| 4,634,013 | 1/1987 | Bar-Kokhba | 215/257 |
| 4,696,401 | 9/1987 | Wallace | 206/594 |
| 4,709,822 | 12/1987 | Vataru | 215/216 |
| 4,747,501 | 5/1988 | Greaves | 215/253 |

*Primary Examiner*—Stephen Marcus
*Assistant Examiner*—Paul A. Schwarz
*Attorney, Agent, or Firm*—ROBIC

[57] ABSTRACT

A cap is disclosed, for use on a container having a neck defining an opening sealed by a protective foil that has to be removed when the container is used for the very first time. The cap comprises a top sized to close the opening and a peripheral skirt that projects from the top and is detachably connectable to the wall of the neck. The cap also comprises at least one and preferably two open slots made in the skirt, the slots extending at angle from the bottom edge of the slot and being wide engage to receive the wall of the neck. The slots make the skirt to define spikes that preferably are oppositely oriented for use by right-handed or left-handed persons to perforate and remove the protective foil sealing the neck of the container when the latter has to be opened for the very first time.

6 Claims, 2 Drawing Sheets

CAP WITH PERFORATING SPIKE FOR CONTAINER WITH A PROTECTIVE MEMBRANE

BACKGROUND OF THE INVENTION

The present invention is concerned with a cap for use on a container, such as a pill container, a coffee container or any other kind of similar container whose opening is sealed by a protective foil or membrane usually made of plastic material aluminum or both of them, that has to be removed when one opens the container for the very first time.

BRIEF DESCRIPTION OF THE PRIOR ART

As is known, it is sometimes very difficult to remove the protective foil or membrane that is glued onto the opening of some containers, such pill containers, a food containers and the like, because of a lack of positive grasp for the fingers. It is then necessary to use a knife, a can opener or any other spike-defining element to perforate the foil and then make it possible to tear it off.

U.S. Pat. Nos. 4,634,013 and 4,709,822 each disclose a cap adapted to close the neck of a bottle sealed by a membrane. The cap includes a small cutting blade into its structure, in order to facilitate perforation and removal of the sealing membrane. The perforation is made in a direction perpendicular to the sealed opening of the bottom.

U.S. Pat. No. 4,747,501 discloses a cap for container, incorporating a stud that can be used to push out the sealing membrane closing the opening of the container. This kind of cap is well known and found in most of the tooth paste tubes presently available in the market.

U.S. Pat. Nos. 2,131,774 and 2,131,775 each disclose a tamper-proof cap for bottle, which is devised in such a manner as to cause perforation of a seal if one tries to open the bottle.

Last of all, U.S. Pat. Nos. 2,837,833; tries to open the bottle. 4,204,604 and 4,696,401 disclose closure systems for containers, including knives or prongs that "automatically" cut out a safety seal if one tries to open the bottle. In this particular case, the cutting is made in a plane parallel to the opening of the neck, contrary to U.S. Pat. No. 4,634,013 and 4,709,822 mentioned hereinabove, where the cutting is made in a direction perpendicular to the opening.

SUMMARY OF THE INVENTION

The object of the present invention is to provide a cap for use on a container having a neck with a wall defining an opening sealed by a protective foil that has to be removed when a container is opened for the very first time, which cap is devised in such a manner as to form at least one spike that may have used to perforate the protective foil and thus facilitates removal of the same.

Another object of the present invention is to provide the cap of the above mentioned type, which is much simpler in structure and use than the similar caps known to the Applicant.

The cap according to the invention comprises, as most of the existing caps, a top portion sized to close the opening of the neck of the container, and a peripheral skirt portion that projects from the top portion and has the bottom edge and is detachably connectable by either screwing or snapping to the wall of the neck in order to provide attachment of the cap of the container in such a manner that the top portion of the cap closes the opening.

In accordance with the invention, this cap of conventional structure is improved in that it further comprises at least one and preferably two open slots made in the skirt, eaoh slot extendinq at angle from the bottom edge of the skirt and being wide enough to engage the wall of the neck.

Each slot so made in the skirt, defines one spike that can be used to perforate and remove the protective foil sealing the container when the container has to be opened for the very first time, substantially like a conventional can opener.

BRIEF DESCRIPTION OF THE DRAWINGS

The invention and its advantages will be better understood upon reading the following non restrictive description of two preferred embodiments thereof, given reference to the accompanying drawings in which.

DESCRIPTION OF THE PREFERRED EMBODIMENTS

Figure 1:
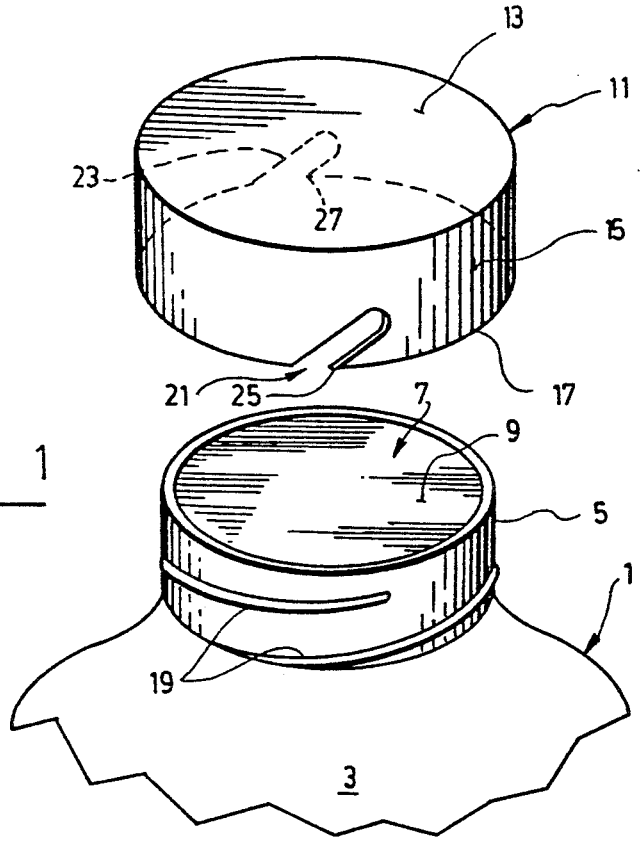
FIG. 1 is an exploded view of a seal container with a cap according to the invention.
Figure 2:
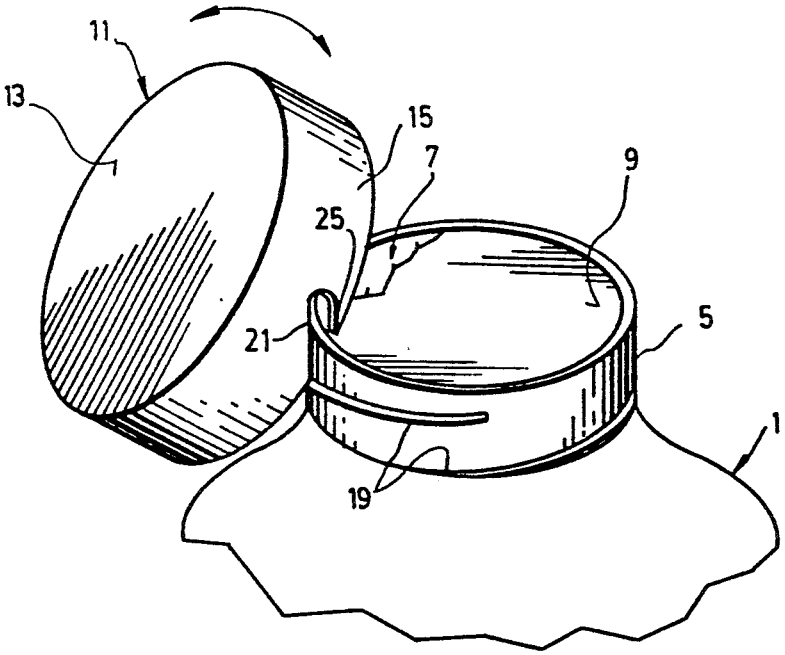
FIG. 2 is a perspective view of the top of the container shown in FIG. 1, with the cap in use.

FIGS. 1 and 2 show a first embodiment of the invention.

In this first embodiment, the container 1 is in a form of bottle having a main body 3 intended to receive some product, such as for example coffee, and a neck 5 which defines an opening sealed by a protective foil 7 made of aluminium, rigid paper, plastic material or laminated plastic and metal foils. Of course, this protective foil which is used either as a tamper-proof device and/or as an airtight barrier to protect the product inside the bottle 3, has to be removed when the container is sold and opened for the very first time, in order to have access to the product within the bottle.

The container 1 is closed by a cap 11 comprising a top portion 13 sized to close the opening 7, and a peripheral skirt portion 15 that projects from the periphery of the top portion 13. The cap 11 is detachably connectable to the external surface of the wall of the neck 5 by means known per se, that may consist of opposite threads 17 provided of the external surface of the wall of the neck 5 and the internal surface of the skirt 15. In such a case, the wall of the neck 5 and the skirt 15 must of course be cylindrical to allow screwing of the cap onto the neck.

In accordance with the invention, at least one and preferably two open slots 21, 23 are made in the skirt 15, each slot extending at angle from the bottom edge 17 of the skirt 15. Each slot is also wide enough to engage or "receive" the wall of the neck 5 and thus makes the cap capable of straddling onto the neck as is shown in FIG. 2.

As is clearly shown in FIG. 1, each slot 21, 23 makes the skirt to define a spike 25, 27, that can be used to perforate and remove the protective foil 9 when the container has to be opened for the very first time, as is shown in FIG. 2. Advantageously, the slots 21 and 23 are oriented at angle in opposite directions as is shown in FIG. 1, to define a spike for left-handed persons and another spike for right-handed persons. This makes the cap according to the invention easy to use by everybody.

Figure 3:
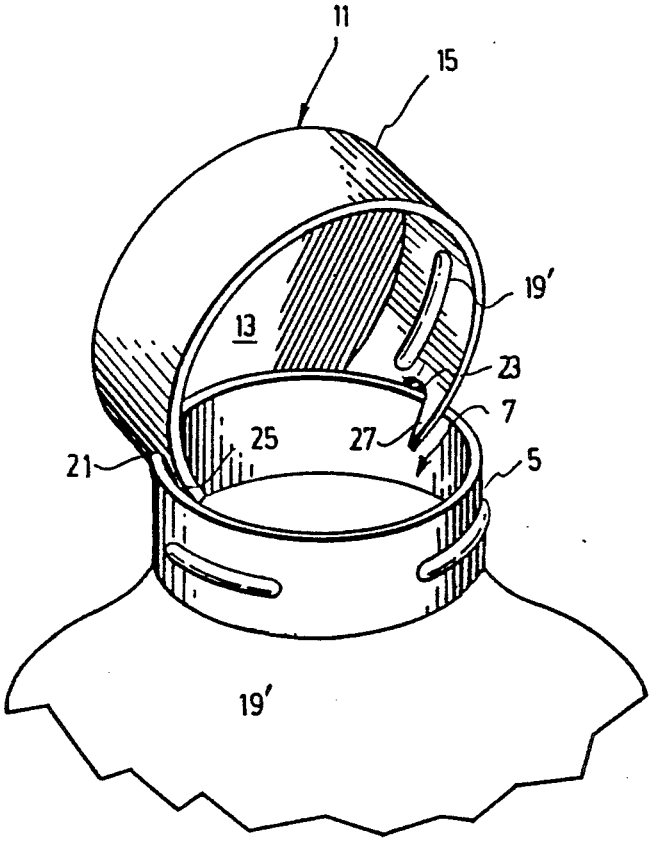
FIG. 3 is a perspective view of the top portion of another cap according to the invention.

Another embodiment of the invention is shown in FIG. 3.

This other embodiment is substantially identical to the one shown in FIGS. 1 and 2, except that the wall of the neck 5 and the skirt 15 of the cap include opposite male and female elements 19, to allow detachable connection of the cap to the neck by snapping. In such a case, it is not compulsory that the cap and neck be both cylindrical.

As is shown in FIG. 3, the open slots 21 and 23 may also be positioned in such a manner as to be close enough to each other to allow fixation of the cap in a semi vertical position to the wall of the neck whenever desired. This permits to put away the cap in a clean and easy-to-find manner.

As can be understood, the main advantage of the invention is that it is very simple to manufacture and use. As a matter of fact, this invention can be implemented onto any existing cap in a very easy and efficient manner.

Of course, other modifications could be made to the above identified embodiments without departing from the scope of the invention as defined in the appended claims.

I claim:

1. The combination of a cap with a container having a neck with a wall defining an opening sealed by a protective membrane that has to be removed when the container is to be opened for the very first time, said cap comprising a top portion sized to close said opening and a peripheral skirt portion that projects from said top portion and has a bottom edge, the wall of said neck and the skirt portion of said cap including opposite male and female elements to allow detachable connection of the cap to the neck by snapping in such a manner that said top portion of said cap closes said opening, wherein said cap further comprises at least one open slot made in said skirt portion, said at least one open slot extending at an angle from the bottom edge of said skirt portion and being wide enough to engage the wall of said neck, whereby said at least one slot makes said skirt to define a spike that can be used to perforate and remove the protective membrane when the container is opened for the very first time.

2. The improved cap of claim, 1 wherein said at least one open slot comprises two open slots made in the skirt of said cap, said slots being oriented in opposite directions to define a spike for left-handed and another spike for right-handed.

3. The improved cap of claim 2, wherein the two open slots are close to each other and oriented in such a manner as to allow fixation of the cap in semi-vertical position to the wall of the neck.

4. The combination of a cap with a container having a neck with a wall defining an opening sealed by a protective membrane that has to be removed when the container is to be opened for the very first time, said cap comprising a top portion sized to close said opening and a peripheral skirt portion that projects from said top portion and has a bottom edge, the wall of said neck and the skirt portion of said cap being both generally cylindrical and including opposite thread elements to allow detachable connection of the cap to the neck by screwing; in such a manner that said top portion of said cap closed said opening, wherein said cap further comprises at least one open slot made in said skirt portion, said at least one open slot extending at an angle from the bottom edge of said skirt portion and being wide enough to engage the wall of said neck, whereby said at least one slot makes said skirt to define a spike that can be used to perforate and remove the protective membrane when the container is opened for the very first time.

5. The improved cap of claim 4, wherein said at least one open slot comprises two open slots made in the skirt of said cap, said slots being oriented in opposite directions to define a spike for left-handed and another spike for right-handed.

6. The improved cap of claim 5, wherein the two open slots are close to each other and oriented in such a manner as to allow fixation of the cap in semi-vertical position to the wall of the neck.

* * * * *